US009192231B1

(12) United States Patent
Steffen

(10) Patent No.: US 9,192,231 B1
(45) Date of Patent: Nov. 24, 2015

(54) CURIO CABINET WITH CONCEALED GUN RACK

(71) Applicant: Daniel W. Steffen, El Paso, IL (US)

(72) Inventor: Daniel W. Steffen, El Paso, IL (US)

( * ) Notice: Subject to any disclaimer, the term of this patent is extended or adjusted under 35 U.S.C. 154(b) by 0 days.

(21) Appl. No.: 14/179,000

(22) Filed: Feb. 12, 2014

(51) Int. Cl.
*A47B 77/00* (2006.01)
*A47B 87/00* (2006.01)
*A47B 3/14* (2006.01)
*A47B 81/00* (2006.01)

(52) U.S. Cl.
CPC ..... *A47B 81/005* (2013.01)

(58) Field of Classification Search
CPC ..... A47B 81/002; A47B 46/00
USPC ..... 312/321.5, 291, 204, 326, 245, 120, 312/107
See application file for complete search history.

(56) References Cited

U.S. PATENT DOCUMENTS

| | | | | | |
|---|---|---|---|---|---|
| 492,304 | A | * | 2/1893 | Markle | 312/135 |
| 799,725 | A | * | 9/1905 | Fisher | 312/123 |
| 1,071,760 | A | * | 9/1913 | Lanoue | 312/123 |
| 1,509,285 | A | * | 9/1924 | Colbow, Jr. | 109/54 |
| 2,730,392 | A | * | 1/1956 | Thiebaud | 292/201 |
| 2,739,024 | A | * | 3/1956 | Elman | 312/283 |
| 3,089,745 | A | * | 5/1963 | Postula et al. | 312/324 |
| 3,140,134 | A | * | 7/1964 | Nairn | 312/204 |
| 3,340,956 | A | * | 9/1967 | Owen, Jr. | 181/145 |
| 3,848,940 | A | | 11/1974 | Berens | |
| D240,685 | S | * | 7/1976 | Eisen | D6/438 |
| D255,406 | S | * | 6/1980 | Stephens | D6/438 |
| D260,710 | S | * | 9/1981 | Miller | D6/438 |
| 4,502,742 | A | * | 3/1985 | Neff | 312/324 |
| 4,925,255 | A | | 5/1990 | DeBlaay | |
| 5,048,901 | A | | 9/1991 | DeBlaay | |
| 5,180,222 | A | * | 1/1993 | Robinson | 362/125 |
| 5,188,405 | A | * | 2/1993 | Maccaferri | 292/204 |
| D340,595 | S | * | 10/1993 | Jacquinot | D6/433 |
| D343,970 | S | * | 2/1994 | Campbell | D6/437 |
| 5,485,733 | A | * | 1/1996 | Hoffman | 70/276 |
| 5,681,100 | A | | 10/1997 | Powell | |
| 5,709,441 | A | * | 1/1998 | Bartling et al. | 312/107 |
| 5,769,516 | A | * | 6/1998 | Aguilera | 312/321.5 |
| 5,820,238 | A | * | 10/1998 | Lambright | 312/291 |
| 6,033,046 | A | * | 3/2000 | Lambright | 312/321.5 |
| 6,840,592 | B2 | * | 1/2005 | Kalieta et al. | 312/326 |
| 6,868,975 | B2 | * | 3/2005 | Sells et al. | 211/4 |
| 6,926,136 | B1 | * | 8/2005 | Lynch-Bass | 206/6.1 |
| 7,261,385 | B2 | * | 8/2007 | Weinberger | 312/330.1 |
| 7,445,255 | B2 | * | 11/2008 | Nye-Hingston et al. | 292/144 |
| 7,478,892 | B2 | * | 1/2009 | Punzel et al. | 312/322 |
| 8,141,962 | B2 | * | 3/2012 | Ohfuchi et al. | 312/201 |
| 8,485,613 | B1 | | 7/2013 | Steffen et al. | |
| 8,814,284 | B2 | * | 8/2014 | Lee et al. | 312/291 |
| 2005/0115912 | A1 | * | 6/2005 | Szuminski et al. | 211/64 |
| 2008/0111454 | A1 | * | 5/2008 | Spoljaric | 312/209 |
| 2008/0122326 | A1 | * | 5/2008 | Johnson et al. | 312/249.1 |
| 2009/0115298 | A1 | * | 5/2009 | Parsons et al. | 312/326 |

(Continued)

*Primary Examiner* — Daniel J Troy
*Assistant Examiner* — Kimberley S Wright
(74) *Attorney, Agent, or Firm* — Robert C. Montgomery; Montgomery Patent and Design LLC

(57) ABSTRACT

A curio cabinet with gun storage comprises a curio cabinet and a hidden compartment. The curio cabinet is in the style of a traditional flatback-type curio cabinet and comprises a plurality of shelves and compartments. A main compartment of the curio cabinet comprises the rear hidden compartment. The hidden compartment is accessed through hinged doors in the main compartment. The hidden compartment provides a means to store firearms.

16 Claims, 4 Drawing Sheets

(56) References Cited

U.S. PATENT DOCUMENTS

2009/0195128 A1* 8/2009 Harvey ..... 312/204
2009/0230826 A1 9/2009 Myers
2012/0206026 A1* 8/2012 Emelio ..... 312/204
2014/0132131 A1* 5/2014 Thomas ..... 312/204

* cited by examiner

CURIO CABINET WITH CONCEALED GUN RACK

RELATED APPLICATIONS

Not applicable.

FIELD OF THE INVENTION

The presently disclosed subject matter is directed towards gun racks. More specifically, the present invention is directed to gun racks concealed in mirrored cabinets.

BACKGROUND OF THE INVENTION

Gun owning and collecting are major interests to many Americans. Responsible owners of weapons, rifles, shotguns, handguns, knives, and the like typically keep their weapons locked and out of sight at all times. One (1) common way of doing this is to store the weapons in a gun rack, also known as a gun safe or gun cabinet.

Gun racks have proven to be very effective at storing weapons and at preventing accidental injuries. However, firearms are relatively expensive and a major gun collection can be worth significant money. The mere presence of a gun rack may alert others that firearms are present within a household. This can and has led to the theft of firearms.

Another problem with gun racks is that they tend to be rather large. Many households simply do not have available storage space in the house for a large gun rack in addition to the other furniture. Furthermore, while gun racks are useful, usually they are not particularly attractive furniture pieces (they can be however, usually at great cost). Therefore many gun racks are located within garages, basements, or other areas, which tend to make the contained firearms not readily available should quick access be required.

Accordingly, there exists a need for a way to safely and securely store firearms and other weapons without the disadvantages described above.

Curio cabinets are traditional pieces of furniture that are used to display cherished items. Such cabinets usually have ample shelving that can be versatility arranged. Curio cabinets are almost always "fine" furniture. That is, they are usually quality made from quality woods and other materials, they are given a superior finish, they are artistically pleasing to look at, and they usually improve the aesthetics of the room in which they are located. Curio cabinets often have features such as multiple beveled glass doors mounted on touch activated hinges, multiple glass shelves, quality interior lighting, and a polished exterior. While they are often rather tall and heavy, thus not easily moved, curio cabinets are almost always kept inside the home so that they and their contents can be appreciated.

Therefore, a technique of using a curio cabinet as a gun rack would be useful. Even more useful would be a technique of using a curio cabinet as a gun rack such that the weapons stored therein are readily available when needed. Beneficially, such a curio cabinet gun rack would hide the weapons from view and would not reveal to others that weapons were kept therein. Preferably, the depth of the curio cabinet would be obscured with mirrors.

SUMMARY OF THE INVENTION

The principles of the present invention provide for gun safes hidden in furniture. In particular, the principles of the present invention provide for mirrored cabinets having hidden gun racks.

A cabinet with a concealed gun rack in accord with the principles of the present invention has a top (half) with rectangular first and second rear panels that are affixed together along a common side edge, a rectangular first side panel that is affixed to the first rear panel along a common side edge, a rectangular second side panel that is fixed to the second rear panel along a common side edge, and a door frame that is pivotally attached to the first side panel using a door hinge. The door frame is dimensioned to span between the door hinge and a free side edge of the second side panel. The first and second rear panels, the first and second side panels, and the door frame form a first five sided perimeter that defines an interior region. Inside the interior region is at least one set of gun mounting hardware. A top panel is attached to the first and second rear panels and to the first and second side panels along common top edges. The top panel defines a second five sided perimeter that has sides parallel to the first five sided perimeter. A mirrored structure made from a rigid mirror backing has a first mirror panel that is attached to a first side of the mirror backing and a second mirror panel that is attached to a second side of the mirror backing. The mirrored structure extends into the interior region. The mirrored structure is pivotally attached to the door hinge such that the door frame and the mirrored structure pivot independently. The mirrored structure is also dimensioned to span between the door hinge and the free side edge of the second side panel.

The foregoing structure provides for a hidden gun rack behind a cabinet because the mirrored structure hides the gun mounting hardware. Preferably, the first side panel is disposed opposite the second rear panel and the second side panel is disposed opposite the first rear panel. This forms a square with a cut-off corner. The gun mounting hardware can be used to mount a long gun (rifle) or a hand gun.

In practice the door frame will hold a transparent door window and will include a door handle (knob). Preferably, at least one (1) shelf will be visible through the door frame. The top panel can include a light for illuminating the shelf and can also include decorative crown molding. Preferably, the door hinge is a piano hinge that extends the entire height of the door frame.

The cabinet with concealed gun rack can also include a bottom panel beneath the first and second rear panels, the first and second side panels, and the door frame. Beneath the bottom panel may be a bottom section that has a perimeter shape similar to the first five sided perimeter. Preferably the bottom section includes at least one (1) door. The bottom panel can include a bottom transparent member and the bottom section can include a bottom light. The bottom light can pass through the bottom transparent member and illuminate the shelf. A switch can be used to selectively illuminate the bottom light.

A cabinet with a concealed gun rack preferably includes a latch that latches the mirrored structure closed. Beneficially, the mirrored structure is beveled so as not to contact the door frame when the door frame is closed.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
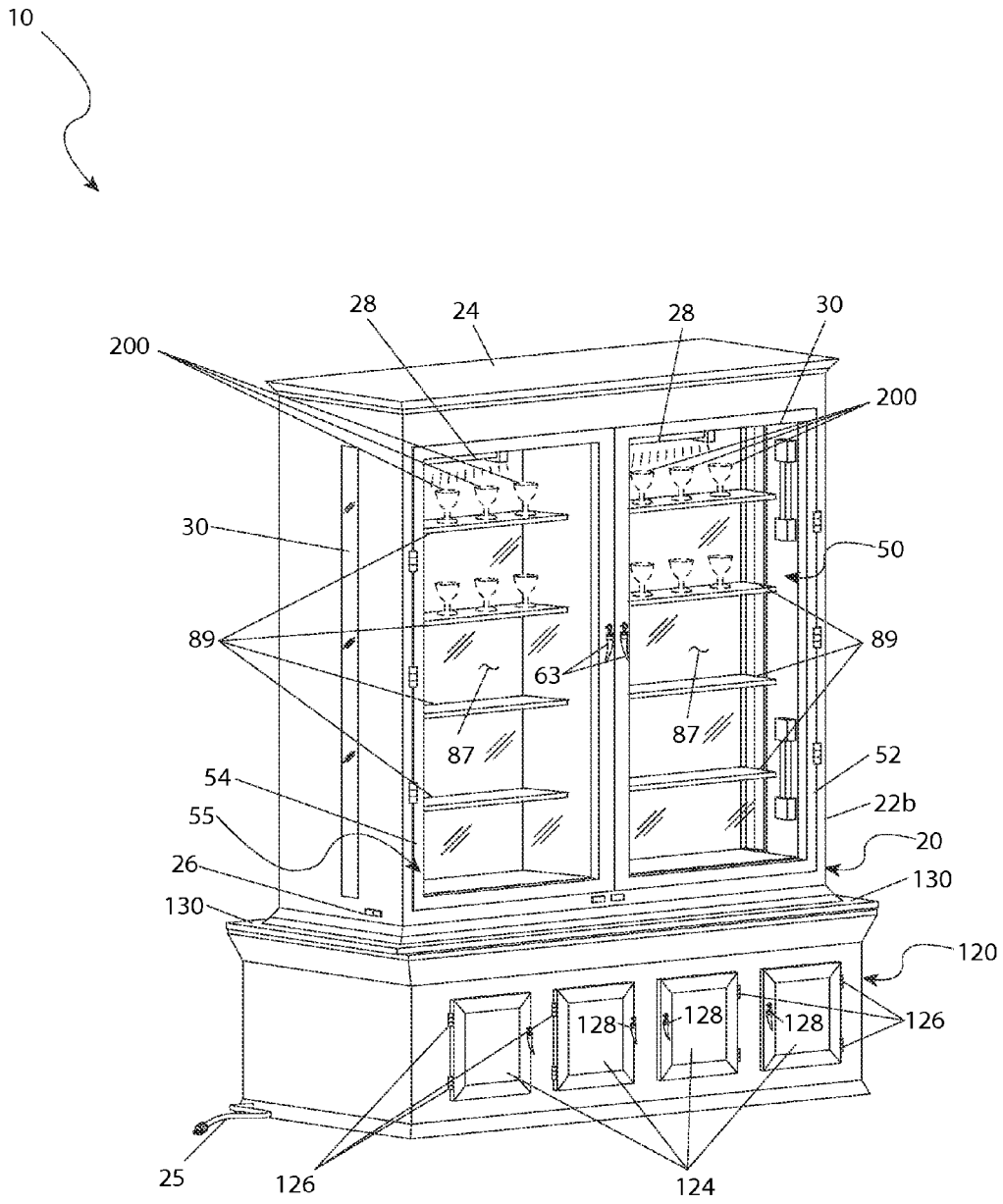
FIG. 1 is a perspective front view of a curio cabinet with gun storage 10, according to a preferred embodiment of the present invention.

10 curio cabinet with gun storage
20 upper cabinet assembly
21*a* left side panel
21*b* right side panel
22*a* rear panel
22*b* front panel
24 top panel
25 power cord
26 switch
28 lighting unit
30 side glass
50 right door assembly
52 right door frame
54 left door frame
55 left door assembly
57 door handle
59 door glass
61 door hinge
63 door handle
65 door latch
80 right shelving assembly
82 right shelving enclosure
85 left shelving assembly
86 left shelving enclosure
87 rear mirror panel
88 center mirror panel
89 shelf
91 shelf assembly hinge
93 locking mechanism
95 key
120 base cabinet assembly
122 base cabinet
124 base door
126 base door hinge
128 base door handle
130 base upper panel
150 gun storage space
152 floor panel
154 long gun mounting rail
156 long gun slot
158 handgun peg
200 decorative item
202 firearm

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a curio cabinet with gun storage (herein described as the "apparatus") 10, which provides a means for both displaying decorative items 200 and for storing firearms 202 in a concealed manner within gun storage space 150. The apparatus 10 appears to be a display cabinet having a plurality of shelves 89 and doors 50, 55 for storage and display of decorative items 200. However, the apparatus 10 also includes a gun storage space 150 for storing a plurality of firearms 110 located behind the shelving portions 80, 85, thereby not being readily apparent to a casual observer.

Referring now to FIG. 1, a front perspective view of the apparatus 10, according to a preferred embodiment of the present invention, is disclosed. The apparatus 10 comprises an upper cabinet assembly 20, a right door assembly 50, a left door assembly 55, a right shelving assembly 80, a left shelving assembly 85, and a base cabinet assembly 120.

The upper cabinet assembly 20 provides a rectangular structure further comprising a left side panel 21*a*, a right side panel 21*b*, a rear panel 22*a*, a front panel 22*b*, and a top panel 24. Each side panel 21*a*, 21*b* comprises respective side glass portions 30 which provide ample viewing of decorative items 200 placed upon the interior shelving assemblies 80, 85. The front panel 22*b* provides an open construction providing hinged attachment of the right door assembly 50 and the left door assembly 55 which attach to and vertically bisect the front panel 22*b*, having pairs of door hinges 61 upon outer edge portions, respectively. The right 50 and left 55 door assemblies comprise respective right door frame 52 and left door frame 54 perimeter portions having respective door glass portions 59 in a similar manner as the side panels 21*a*, 21*b* to further enable viewing of the decorative items 200 within. The side glass 30 and door glass 59 portions comprise transparent panels preferably comprising rectangular glass panes which provide a clear view of the decorative items 200 stored within the apparatus 10 when the door assemblies 50, 55 are closed.

The door assemblies 50, 55 are arranged in a coplanar manner along a front surface and further comprise respective door handle portions 57 being located along center adjacent edge portions. The top panel 24 is a flat, horizontal panel with a perimeter shape similar to but larger than the perimeter shape of the upper cabinet assembly 20 and preferably comprising a decorative crown molding along its perimeter.

Figure 3:
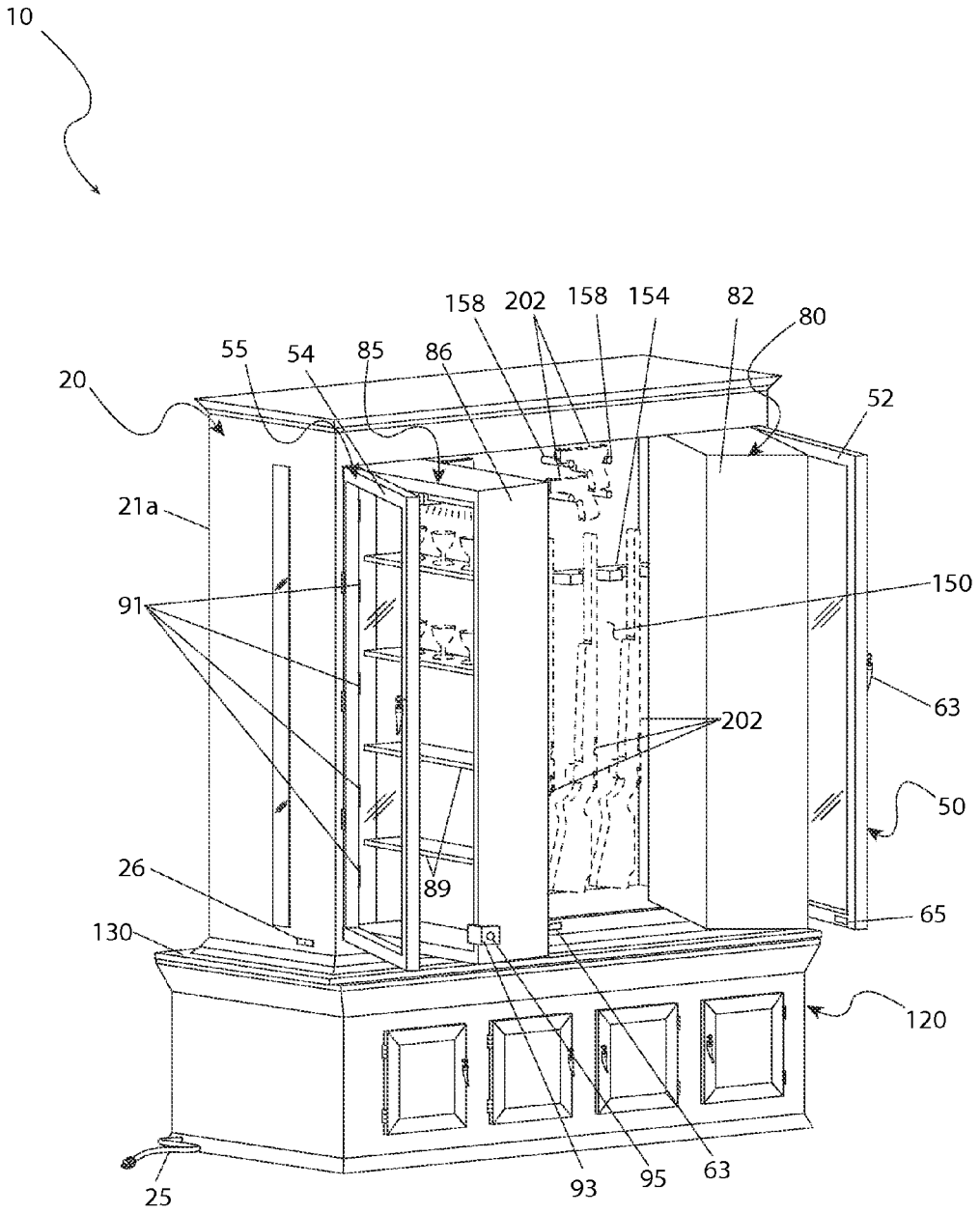
FIG. 3 is a front perspective view of the curio cabinet with gun storage 10 depicting door assemblies 50, 55 and shelving assemblies 80, 85 in an opened state, according to a preferred embodiment of the present invention; and, FIG. 4 is a section view of the curio cabinet with gun storage 10 taken along section line A-A (see FIG. 1), according to a preferred embodiment of the present invention.
Figure 4:
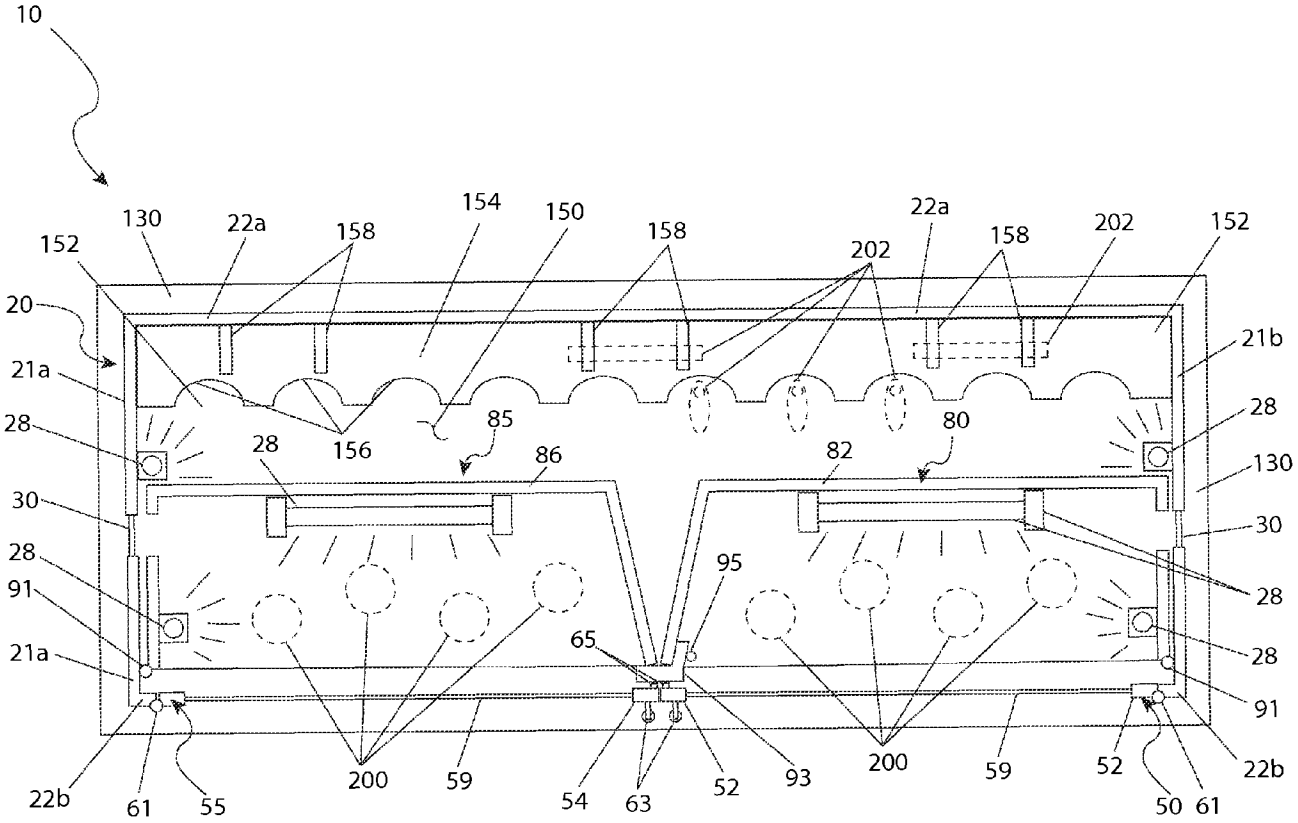

The upper cabinet assembly 20 contains two (2) outwardly hinging shelving assemblies 80, 85 which occupy a forward half portion of the upper cabinet assembly 20, thereby enabling the rearward half portion of the upper cabinet assembly 20 to define a gun storage space 150 for the containment of various firearms 202 (see FIGS. 3 and 4).

The base cabinet assembly 120 provides additional storage space as well as providing an elevating foundation for the upper cabinet assembly 20. The base cabinet assembly 120 provides a low-profile enclosed structure further comprising a rectangular base cabinet 122 having a plurality of base doors 124 along a forward-facing surface being mounted thereto using respective pairs of base door hinges 126, and having respective base door handle portions 128. The base cabinet assembly 120 further comprises a horizontal base upper panel portion 130 covering a top surface and being of a sufficient size to support the previously described upper cabinet assembly 20. The base cabinet assembly 120 is envisioned to be used to store a plurality of desired objects and can be utilized to store firearm accessories used with the firearms 202 hidden in the upper cabinet assembly 20.

In a preferred embodiment of the apparatus 10, the upper cabinet assembly 20 is approximately five feet (5 ft.) in width and four and one-half feet (4½ ft.) in height, and the base cabinet assembly 120 is approximately six feet (6 ft.) in width and two feet (2 ft.) in height. It may further be appreciated that the apparatus 10 can have desirable aesthetic and material features, and designs common for fine furniture, such as decorative trim, inlaid patterns, ornate woodworking, various finishing treatments, varnishes, paints, and the like providing color and protection to the apparatus 10.

The apparatus 10 comprises a plurality of lighting units 28 being discreetly positioned along interior portions to provide illumination of the decorative items 200 and also the firearms 202. Electrical power for said lighting units 28 is provided via a power cord 26 and controlled by a two-position switch 26 such as a toggle or similar device, located along a lower left side of the upper cabinet assembly 20 (also see FIGS. 2, 3, and 4).

Figure 2:
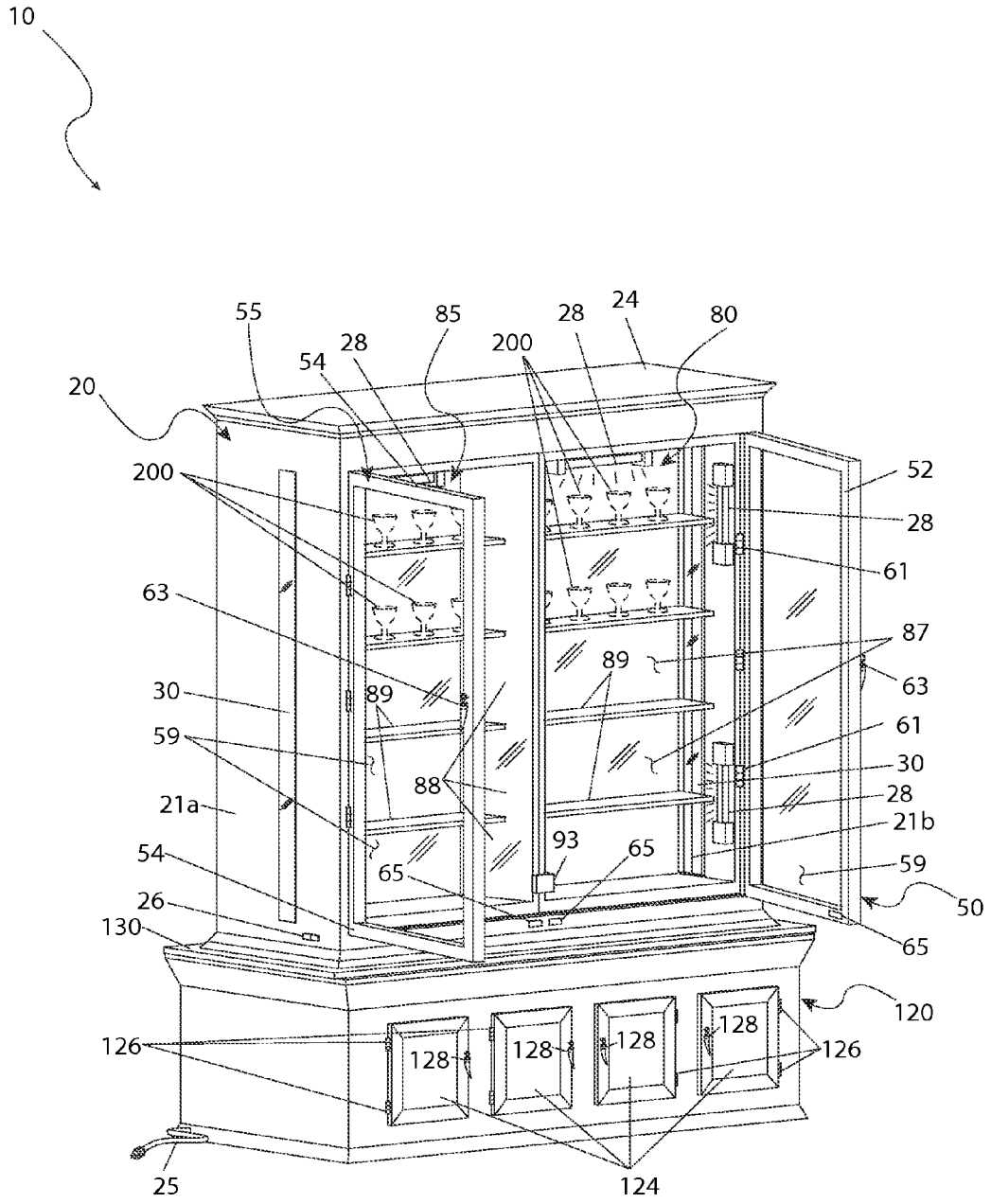
FIG. 2 is a front perspective view of the curio cabinet with gun storage 10 with door assembly portions 50, 55 in an opened state, according to a preferred embodiment of the present invention.

Referring now to FIG. 2, a front perspective view of the apparatus 10 depicting the door assembly portions 50, 55 in an opened state, according to a preferred embodiment of the present invention, is disclosed. In a preferred embodiment, the door assemblies 50, 55 are magnetically fastened to the front panel portion 22*b* of the upper cabinet assembly 20 via a plurality of magnetic door latches 65 located along corresponding edge portions in a conventional manner. When in the open state, the door assemblies 50, 55 provide access to respective right 80 and left 85 shelving assemblies, each comprising a box-like structure further comprising a rear mirror panel 87 and a center mirror panel 88. Said mirror panels 87, 88 comprise standard mirrors adhesively bonded to inner surfaces of the shelving assemblies 80, 85 to reflect light. The shelving assemblies 80, 85 also comprise a plurality of shelves 89, preferably being made using glass. The mirror and glass materials used in the construction of the shelving assemblies 80, 85 allow reflection and transmission of light generated from the lighting units 28 positioned within the upper cabinet assembly 20, thereby effectively illuminating the decorative items 200 having been positioned upon the shelves 89 by a user. The shelves 89 are envisioned being affixed to the shelving assemblies 80, 85 using standard hardware such as brackets, screws, and the like, or may be integrated into the construction of the shelving assemblies 80, 85.

Furthermore, the glass and mirror portions of the shelving assemblies 80, 85 serve to obscure the true depth of the interior of the apparatus 10, thereby visually concealing the gun storage space 150 behind the shelving assemblies 80, 85 where firearms 110 are stored (see FIGS. 3 and 4). The obscured depth of the apparatus 10 makes it less likely that a casual passerby will realize that there is space behind the rear mirror panel portions 87 of the shelving assemblies 80, 85.

Referring now to FIG. 3, a front perspective view of the apparatus 10 depicting door assemblies 50, 55 and shelving assemblies 80, 85 in an opened state, according to a preferred embodiment of the present invention, is disclosed. The shelving assemblies 80, 85 further comprise a plurality of shelf assembly hinges 91 along outer edges and a locking mechanism 93 along center adjacent edges. The shelf assembly hinges 91 comprise axial devices which allow the shelving assemblies 80, 85 to pivot forwardly to reveal the interior gun storage space 150. The locking mechanism 93 acts to join the shelving assemblies 80, 85 at lower center portions. The locking mechanism 93 is envisioned to be positioned directly behind a lower portion of the right 52 and left 54 frame portions of the door assemblies 50, 55, thereby being discreetly concealed behind said door assemblies 50, 55 when in a closed state. In a preferred embodiment, the locking mechanism 93 comprises an "L"-shaped structure being permanently affixed to the left door frame 54, in turn wrapping around an adjacent edge portion of the right door frame 52. The locking mechanism 93 comprises deadbolt and key-operated features which engage the right door frame 52, thereby enabling a user to join the shelving assemblies 80, 85 together securely using a key 95. The locking mechanism 93 prevents unauthorized users from accidentally or intentionally opening the shelving assemblies 80, 85 and accessing the gun storage space 150. However, it can be appreciated that other locking mechanisms such as latches, padlocks, spring-loaded bolts, magnetic latches, and the like can be utilized with similar effect, and as such should not be interpreted as a limiting factor of the apparatus 10.

Referring now to FIG. 4, a section view of the apparatus 10 taken along section line A-A (see FIG. 1), according to a preferred embodiment of the present invention, is disclosed. The apparatus 10 comprises a rearwardly located gun storage space 150 being concealed behind the shelving assemblies 80, 85 when in a closed and locked state, as seen here. The gun storage space 150 is defined by an area located between the shelving assemblies 80, 85 and a rear panel portion 22*a* of the upper cabinet assembly portion 20, and between top panel 24 and floor panel 152 portions of the upper cabinet assembly 20. The gun storage space 150 provides various means to mount, store, and display various types of firearms 202 including a long gun mounting rail 154 and a plurality of supporting handgun pegs 158 being mounted to the rear panel 22*a* which are used to organize and retain the firearms 202 and to prevent them from accidentally falling or moving. The long gun mounting rail 154 further comprises a plurality of equally-spaced long gun slots 156 to support a barrel portion of long gun-type firearms 202 in a conventional manner.

The gun storage space 150 is illuminated by at least two (2) lighting units 28 positioned along corner or ceiling portions. The lighting units 28 preferably comprise florescent fixtures and bulbs which provide sufficient illumination of the firearms 202; however, other lighting means may be utilized such as LED, incandescent, and the like, with equal benefit, and as such should not be interpreted as a limiting factor of the apparatus 10. Furthermore, it is understood that some or all surfaces of the gun storage area 150 are to be covered with a soft material such as felt, or the like, to provide protection to the firearms 202. It is understood that various other firearm mounting hardware such as locking gun racks, pistol hooks, ammunition shelves, vertical pistol racks, and the like can be used with similar effect and as thus should not be interpreted as a limiting factor of the present disclosure.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 1 through 3.

The method of utilizing the apparatus 10 may be achieved by performing the following steps: procuring a model of the apparatus 10 having a desired material construction, size, shape, gun storage space 150 configuration, and aesthetic appearance; placing the apparatus 10 at a desired location within a residence; opening the door assemblies 50, 55 using the door handles 63; placing a desired plurality and variety of decorative items 200 on the shelves 89; unlocking the locking mechanism portion 93 of the shelving assemblies 80, 85; pivoting the shelving assemblies 80, 85 forward to access the gun storage area 150; mounting a desired plurality and variety of firearms 202 and associated accessories upon the long gun mounting rail 154 and handgun pegs 158 within the gun storage area 150; closing the shelving assemblies 80, 85 carefully so as to not disturb the decorative items 200; locking the locking mechanism 93 using the key 95 to prevent the gun storage area 150 from accidental or unauthorized opening; viewing the decorative items 200 through the door glass portions 59 of the door assemblies 50, 55; closing and latching the door assemblies 50, 55; and, benefiting from a decorative yet discreet means to store firearms 202 afforded a user of the present invention 10.

The reflective characteristics of the rear 87 and center 88 mirror panels, the transparency of the shelves 89, the illumination of the lighting units 28, and the decorative items 200 within the shelving assemblies 80, 85, make it difficult for a casual passerby to accurately assess the depth of the shelves 89 as compared to the overall size of the apparatus 10, thereby making it unlikely that a passerby will recognize the presence of the gun storage area 150. The user can selectively turn the lighting units 28 on and off using the light switch 26 to illuminate the shelves 89 for viewing the decorative items 200, or to illuminate the firearms 202 within the gun storage space 150. The user can further store any desired plurality and variety of objects including firearm accessories or ammunition within the gun storage space 150 or the base cabinet assembly 120.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A cabinet with a concealed compartment, comprising:

a top section having rectangular front and rear panels, a rectangular first side panel affixed to said rear panel along a first common side edge and to said front panel along a first opposing common side edge, a rectangular second side panel affixed to said rear panel along a second common side edge and to said front panel along an opposing second common side edge, a first door assembly pivotally attached to said front panel adjacent to said first side panel using a first door hinge, a second door assembly pivotally attached to said front panel adjacent to said second side panel using a second door hinge, said first and second door assemblies dimensioned to span between said first and second side panels, and a bottom panel beneath said front and rear panels, said first and second side panels, and said first and second door assemblies, wherein said front and rear panels, said first and second side panels, and said first and second door assemblies form a first four-sided perimeter that defines an interior region;

a top panel attached to said front and rear panels and to said first and second side panels along common top edges, said top panel defining a second four-sided perimeter;

a first shelving assembly hingedly attached to said first side panel adjacent to said front panel, further comprising a first center mirrored panel and a first rear mirrored panel, each bonded to an inner surface thereof;

a second shelving assembly hingedly attached to said second side panel adjacent to said front panel, further comprising a second center mirrored panel and a second rear mirrored panel, each bonded to an inner surface thereof;

at least one shelf mounted on said first and second shelving assemblies, wherein said at least one shelf is visible through said first and second door assemblies;

at least one light for illuminating an entire area of said first and second shelving assemblies;

at least one gun mounting hardware fixed inside said top section interior region; and, a locking mechanism for removably securing lower portions of said first and second shelving assemblies together;

wherein said first and second shelving assemblies extend into said top section interior region to conceal said at least one gun mounting hardware when both are in a closed state; and, wherein said first and second shelving assemblies pivot outwardly to reveal said at least one gun mounting hardware.

2. The cabinet according to claim 1, further comprising a side glass portion vertically oriented on each said first and second side panels.

3. The cabinet according to claim 1, further comprising a door securing mechanism located on said front panel for securing said first and second door assemblies in a closed position.

4. The cabinet according to claim 3, wherein said door securing mechanism is a plurality of magnetic latches located at center portions of an upper and lower portion of said front panel.

5. The cabinet according to claim 1, further comprising a door window located within a door frame of each first and second door assemblies.

6. The cabinet according to claim 5, wherein door frame of each said first and second door assemblies further has a door handle on a side opposing said first and second door hinge, respectively.

7. The cabinet according to claim 5, wherein said locking mechanism further comprises an L-shaped structure affixed to one of said first or second door assemblies and wrapping around an adjacent edge of an opposing door assembly, said locking mechanism configured to receive a lock.

8. The cabinet according to claim 1, wherein said top panel includes decorative crown molding along second four-sided perimeter.

9. The cabinet according to claim 1 wherein said at least one gun mounting hardware is configured to mount a long gun.

10. The cabinet according to claim 1 wherein said at least one gun mounting hardware is configured to mount a hand gun.

11. The cabinet according to claim 1, wherein said first and second shelving assemblies are beveled so as not to contact said first and second door assemblies when closed.

12. The cabinet according to claim 1, wherein said top section interior region includes at least one light for illuminating said at least one gun mounting hardware.

13. The cabinet according to claim 1, further including a bottom section beneath said bottom panel, said bottom section having a perimeter shape similar to said first four-sided perimeter and defining a bottom section interior region.

14. The cabinet according to claim 13, wherein said bottom section further comprises at least one door providing access to said bottom section interior region.

15. The cabinet of claim 14, wherein said top section further comprises a width of approximately five feet, a height of approximately four and a half feet, and said bottom section further comprises a width of six feet and a height of two feet.

16. The cabinet according to claim 1, further include a switch for selectively illuminating said bottom light.

* * * * *